US006817335B2

(12) United States Patent
Groddeck et al.

(10) Patent No.: US 6,817,335 B2
(45) Date of Patent: Nov. 16, 2004

(54) COVER PLATE FOR A CRANKCASE

(75) Inventors: Michael Groddeck, Meckenbeuren (DE); Michael Hartmann, Friedrichshafen (DE); Franz Edmaier, Friedrichshafen (DE); Juergen Giesselmann, Markdorf (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 10/169,155

(22) PCT Filed: Jul. 3, 2001

(86) PCT No.: PCT/EP01/07577

§ 371 (c)(1),
(2), (4) Date: Jun. 28, 2002

(87) PCT Pub. No.: WO02/04802

PCT Pub. Date: Jun. 17, 2002

(65) Prior Publication Data

US 2003/0000495 A1 Jan. 2, 2003

(51) Int. Cl.[7] ..... F02F 7/00

(52) U.S. Cl. ..... 123/195 C; 123/195 A; 184/6.5

(58) Field of Search ..... 123/195 C, 195 S, 123/196 R, 196 A, 196 AB, 198 C; 184/6.5, 6.8

(56) References Cited

U.S. PATENT DOCUMENTS

| | | | | |
|---|---|---|---|---|
| 3,991,735 A | * | 11/1976 | Horstmann | 123/195 C |
| 5,408,965 A | * | 4/1995 | Fulton et al. | 123/196 AB |
| 5,934,241 A | | 8/1999 | Von Esebeck et al. | |
| 6,073,603 A | | 6/2000 | Sumi et al. | |
| 6,186,111 B1 | * | 2/2001 | Hilbig et al. | 123/195 R |
| 6,253,725 B1 | | 7/2001 | Groddeck et al. | |

FOREIGN PATENT DOCUMENTS

| | | |
|---|---|---|
| DE | 2923993 | 12/1980 |
| DE | 19704209 A1 | 8/1998 |
| DE | 19855562 C1 | 5/2000 |
| GB | 2146699 A | 4/1985 |

* cited by examiner

*Primary Examiner*—Noah P. Kamen
(74) *Attorney, Agent, or Firm*—Crowell & Moring LLP

(57) ABSTRACT

The invention relates to a cover plate (2) for a crankcase (1) of an internal combustion engine. Said cover plate (2) extends over the entire surface area of the crankcase (1). The auxiliary aggregates (6, 7) and filters are mounted on the cover plate (2). In addition, the cover plate (2) comprises channels for guiding media. The invention is advantageous in that it facilitates mounting.

17 Claims, 6 Drawing Sheets

COVER PLATE FOR A CRANKCASE

BACKGROUND AND SUMMARY OF THE INVENTION

The invention relates to a cover plate for a crankcase and a method for assembling said cover plate.

DE 198 55 562, a patent held by the applicant, discloses a crankase. In addition to the chamber for the crankshaft, this crankcase comprises additional chambers, which extend from the long side of the crankcase into its interior. These chambers are formed by the two end panels, a part of the base, and a panel that is adjacent to the crankshaft space. Auxiliary units, specifically pumps and heat exchanger, filters and oil reservoirs, are mounted inside the chambers. In the assembly process, the auxiliary units are installed from the long side. The chambers are then sealed off with a side plate. In the area around the crankshaft chamber, the base of the crankcase is sealed with a cover plate.

Proceeding from the above-described state of the art, the object of the present invention is to improve upon this with respect to an installation-friendly solution.

This object is attained by the present invention via a cover plate for a crankcase, which extends over the entire base of the crankcase. In accordance with one aspect of the invention, the auxiliary units are mounted on this cover plate, forming a single structural unit. And in configuring for this, the cover plate is equipped with channels for conveying media, as well as recesses.

The solution of the invention and its configurations offers the advantage that the cover plate with the auxiliary units can be installed in a single operation from the underside of the crankcase. This results in lower assembly costs and/or improved maintenance access in comparison with the current state of the art. By incorporating the channels for conveying media into the cover plate, the number of sealing points in the crankcase is reduced. With the state-of-the-art crankcase, for example, the line connecting a pump and a heat exchanger passes through the crankshaft chamber. In contrast, with the assembly of the crankcase in the invention, the corresponding lead-through for these lines are dispensed with, resulting in a reduction in the cost of producing the crankcase.

In one configuration of the invention, the cover plate is equipped with a first and a second suction points for the pumps. In accordance with another configuration, the cover plate is equipped with a fluid-channeling device, via which the lubricant can be drawn out of the crankshaft chamber to these first and second suction points. With this fluid-channeling device and the two suction points, dry sump lubrication can be realized.

BRIEF DESCRIPTION OF THE DRAWINGS

In the figures, a preferred exemplary embodiment is illustrated. The diagrams show.

DETAILED DESCRIPTION OF THE DRAWINGS

Figure 1:
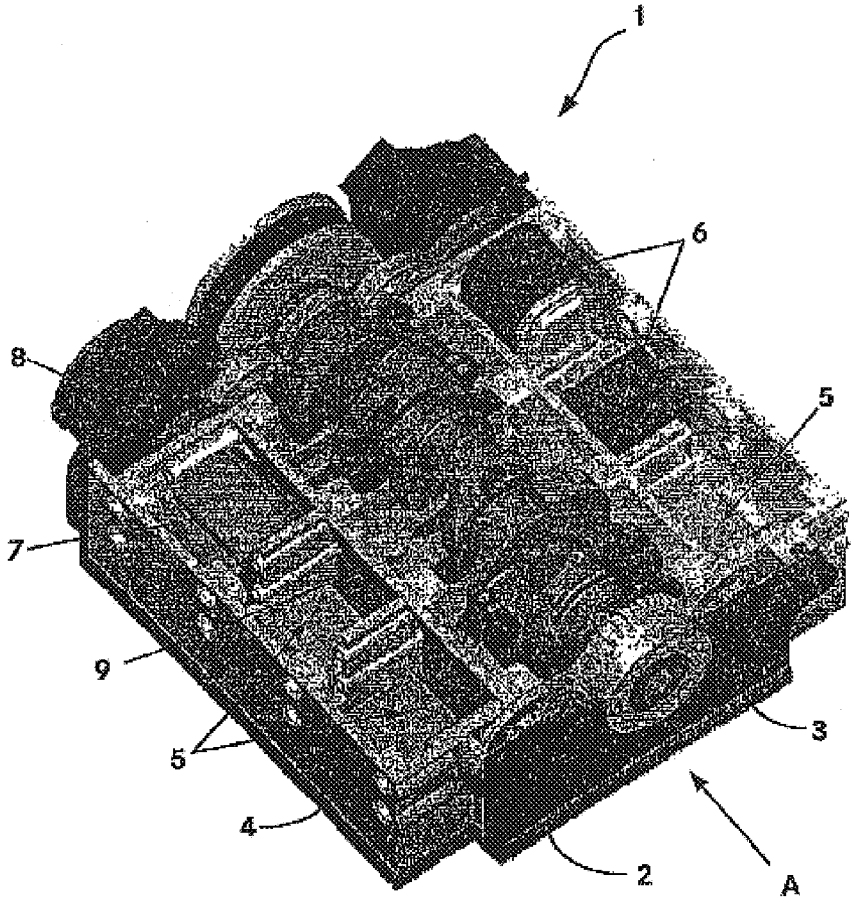
FIG. 1 is a partial view of the crankcase.

FIG. 1 is a partial view of the crankcase 1. The crankcase 1 is enclosed by a cover plate 2, end panels 3, and side panels

4. Inside the crankcase 1 are at least one chamber 5 and one crankshaft space 9. In FIG. 1, a crankshaft without a reference number is shown in the crankshaft chamber 9. In addition, a geared drive 8 is shown on the side opposite the power source. The crankcase in accordance with FIG. 1 has three chambers 5 on each side. The auxiliary units, in this case the heat exchanger 6 and pumps 7, along with filters, are arranged inside these chambers. The chambers 5 also serve as oil reservoirs. The side panels 4 are designed to form a single unit with the crankcase 1. This serves to increase the overall rigidity of the crankcase 1. In the crankcase 1 shown here, the end panels 3 stand on top of the cover plate 2. Naturally, it is also possible for the end panels 3 to cover the end surfaces A, B of the cover plate 2, without altering the character of the invention. The end surfaces A, B are visible in FIG. 1 and/or FIG. 2.

Figure 2:
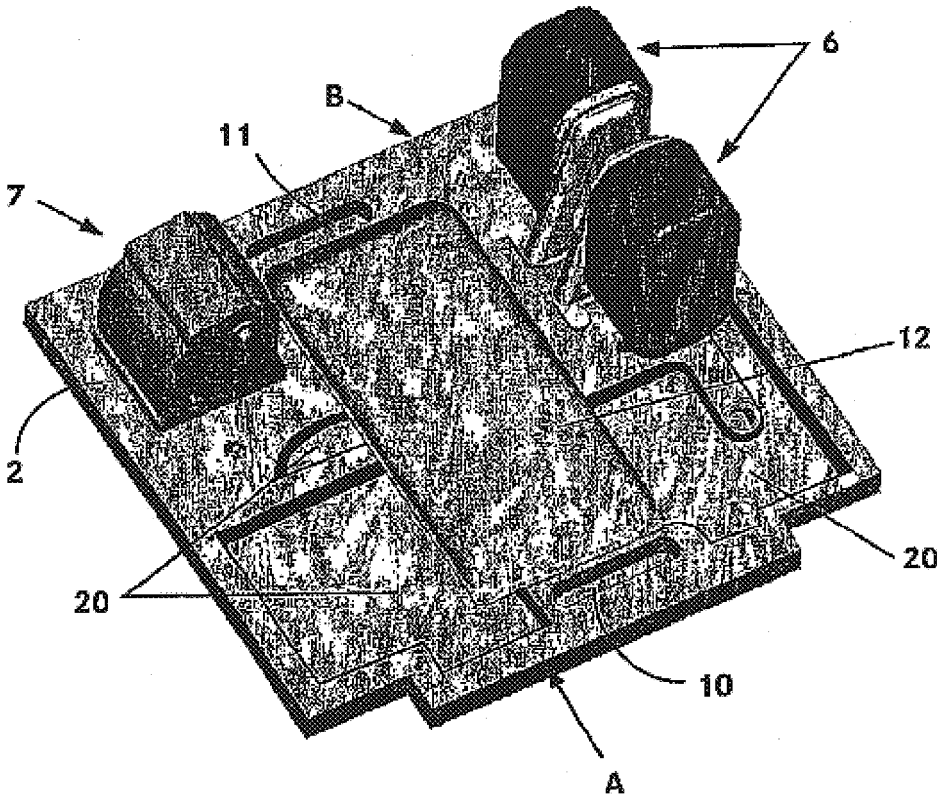
FIG. 2 shows a perspective of a cover plate of the present invention.

FIG. 2 shows a perspective view of the cover plate 2. The heat exchanger 6 and the pumps 7 are already mounted on the cover plate 2. The pumps 7 are suction and pressure pumps. Reference numbers 10 and 11 indicate a first and second suction point for the pumps 7. Reference number 12 indicates a fluid-channeling device, which guides the lubricant out of the crankshaft chamber 9 to the first and second suction points 10 or 11. Channels for guiding various media are incorporated into the cover plate 2. These can be seen in FIG. 3. In FIG. 2, recesses 20 are shown, by way of example. These are positioned around the channels for conveying media. Excepted from this are the areas for sealing, e.g. cover plate 2 to the crankcase 1 to seal out the environment, area C in FIG. 5 and areas for screw couplings. Via these recesses 20, the lubricant that has been degassed and stabilized in the chambers 5 can be drawn to a suction channel 15, see FIG. 3.

Figure 3:
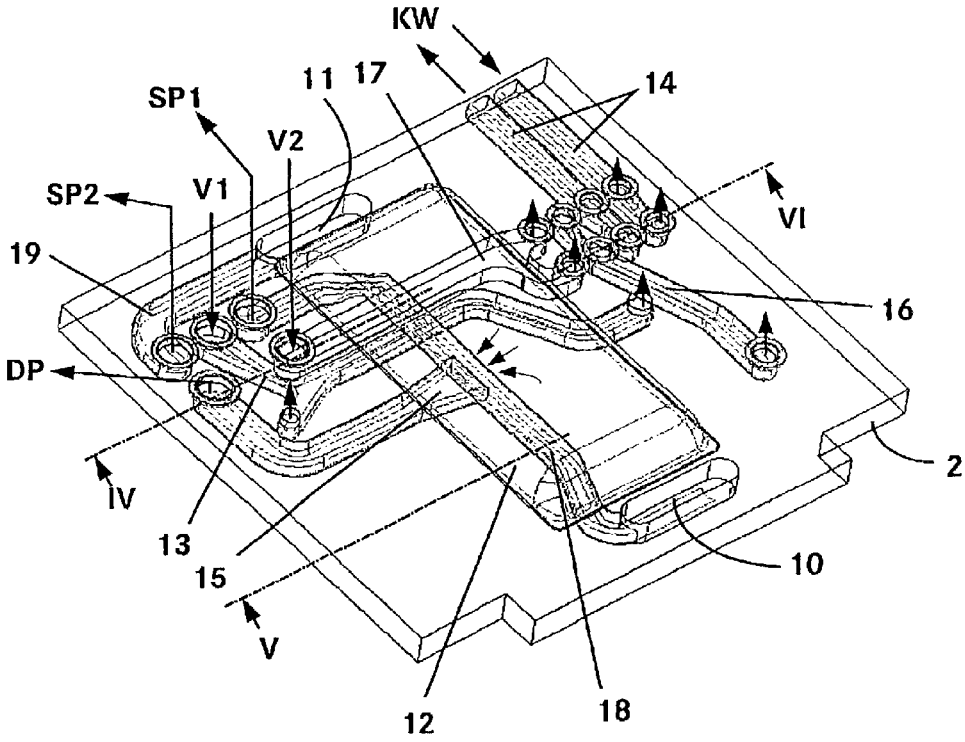
FIG. 3 shows the cover plate with channels.

FIG. 3 shows a transparent view of the cover plate 2 with the channels for conveying media. In this figure, the recesses 20 have been omitted for purposes of clarity. Incorporating the channeling of media into the cover plate 2 serves to reduce the number of required sealing points, and minimizes flow losses. The fluid-channeling device 12 draws the lubricant that drains out of the crankshaft chamber 9 to the first suction point 10 or second suction point 11. From the first suction point 10, the lubricant is drawn in by a first suction pump SP1 via channel 18. In FIG. 3, the direction of suction is indicated by an arrow. The lubricant at the second suction point 11 is drawn in by a second suction pump SP2 via channel 19. The volume of lubricant conveyed by the two suction pumps SP1 and SP2 is then fed to a channel 13. In FIG. 3 this is indicated by reference number VI and a corresponding arrow. Via the channel 13, the lubricant is fed to the chambers 5. In the chambers 5 the lubricant is degassed and stabilized. As is well known, due to the inclined position of the internal combustion engine, the first or second suction pump SP1 or SP2 can also convey air. The degassed and stabilized lubricant can then reach, via the recess 20 (below the fluid-channeling device 12), a suction channel 15. The lubricant is drawn off through this suction channel by a pressure pump DP. The entire volume V2 that is drawn off is fed to the heat exchangers via a channel 17. Cooling water KW is drawn to or from the heat exchangers 6 via channels 14. A channel 16 serves to draw the lubricant out of the heat exchangers 6 to a filter that is not shown here.

Figure 4:
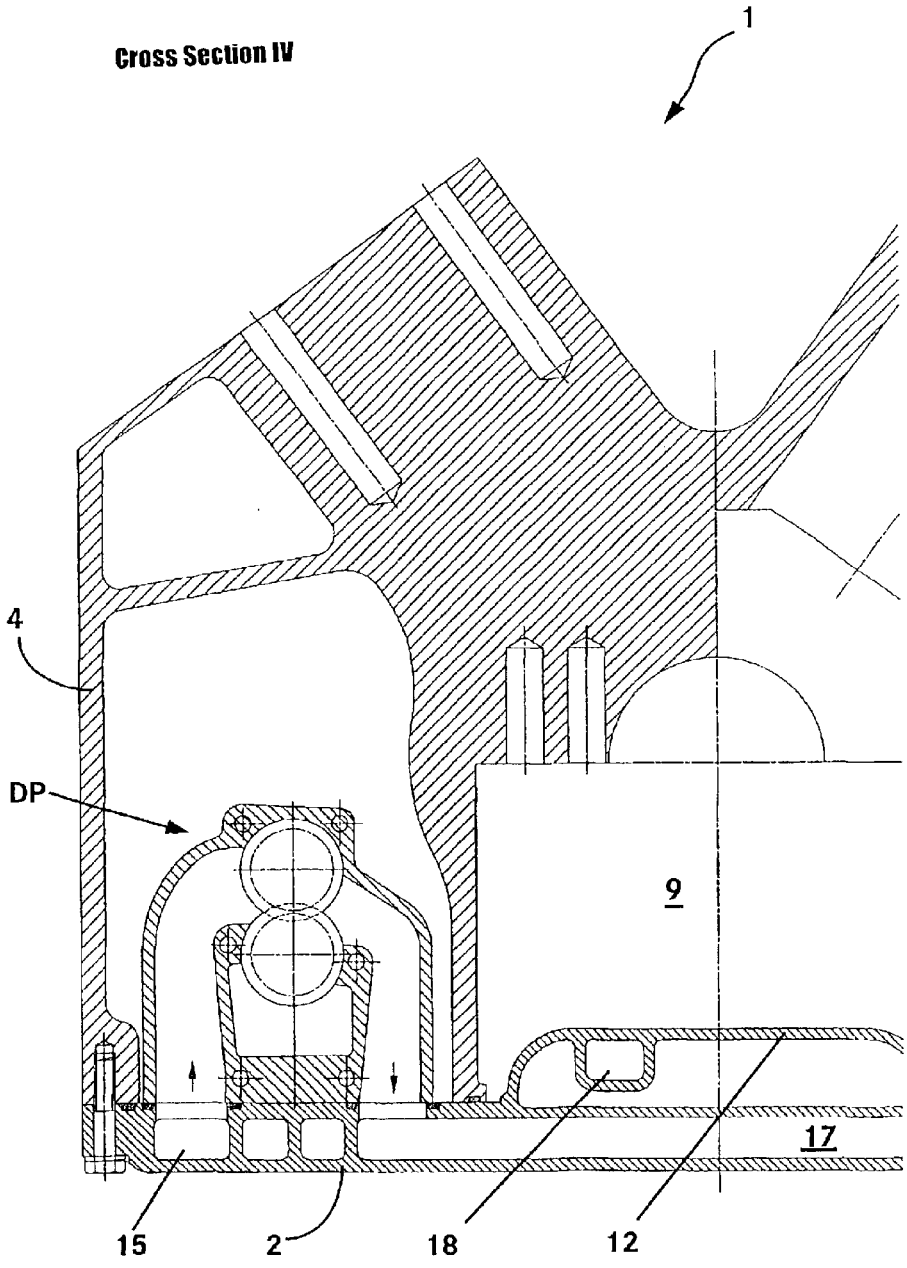
FIG. 4 is a first sectional view of the cover plate.
Figure 5:
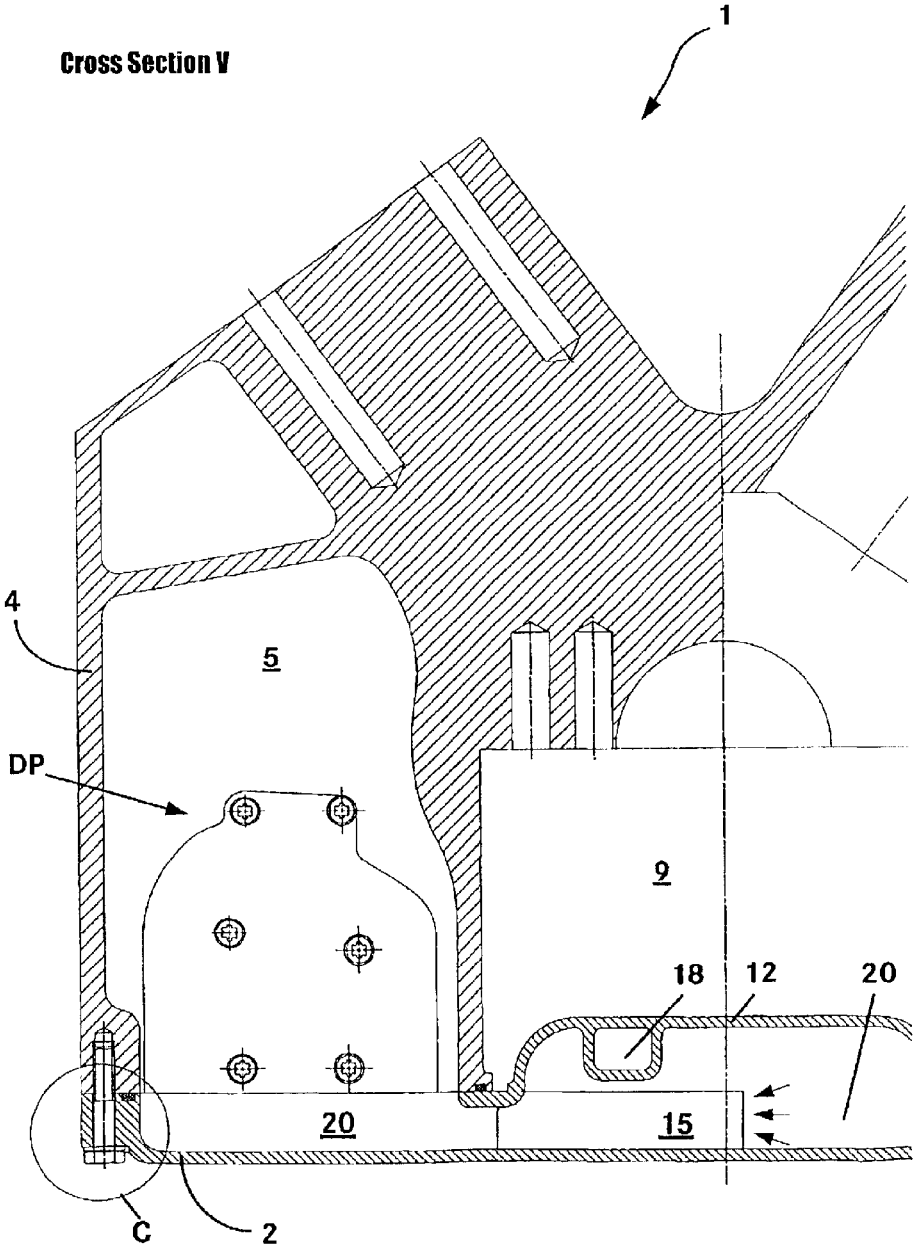
FIG. 5 is a second sectional view of the cover plate.

FIG. 3 also indicates three lines of intersection. One section along the line IV through the left side of the crankcase 1 with the cover plate 2 is shown in FIG. 4. One section along line V through the left side of the crankcase 1 with the cover plate 2 is shown in FIG. 5. One sectional diagram along the line VI through the right side of the crankcase 1 with the cover plate 2 is shown in FIG. 6.

In FIG. 4, a first sectional illustration is represented through the left side of the crankcase 1 with the cover plate 2, along the line IV. In FIG. 4, the pressure pump DP is visible. Behind the pressure pump are the suction pumps Sp1/Sp2. The two suction pumps convey the lubricant that is found in the two suction points 10 and 11 into channel 13, via channels 18 and 19. Through channel 13, the lubricant is fed to the chambers 5 of the crankcase 1 for degasification and stabilization. The degassed and stabilized lubricant is then drawn in by the pressure pump DP, through the suction channel 15. The pressure pump DP draws in the lubricant via channel 17, at volume V2, to the heat exchangers 6. As is shown in FIG. 4, the fluid-channeling device 12 is here constructed in one piece with the cover plate 2. The lubricant that drips out of the crankshaft chamber 9 is fed by the fluid-channeling device 12 into the two suction points 10 and 11. Thus the connection between the first suction point 10 and the suction pump SP1 is situated inside the fluid-channeling device 12, as is shown in this sectional illustration of the channel 18.

FIG. 5 shows a second sectional illustration through the left side of the crankcase 1 with cover plate 2, along the line V. In this section, recesses 20 are visible. These are located around the channels for carrying various media. Excepted from this are the areas for sealing, e.g. the cover plate 2 to the crankcase 1 to seal out the environment, area C in FIG. 5 and areas designed for screw coupling. Through these recesses 20, the degassed and stabilized lubricant of the chambers 5 reach suction channel 15. The lubricant is conveyed to the heat exchangers 6 by the pressure pump DP through channel 17. The discussion in connection with FIG. 4 applies for the function of the fluid-channeling device 12.

Figure 6:
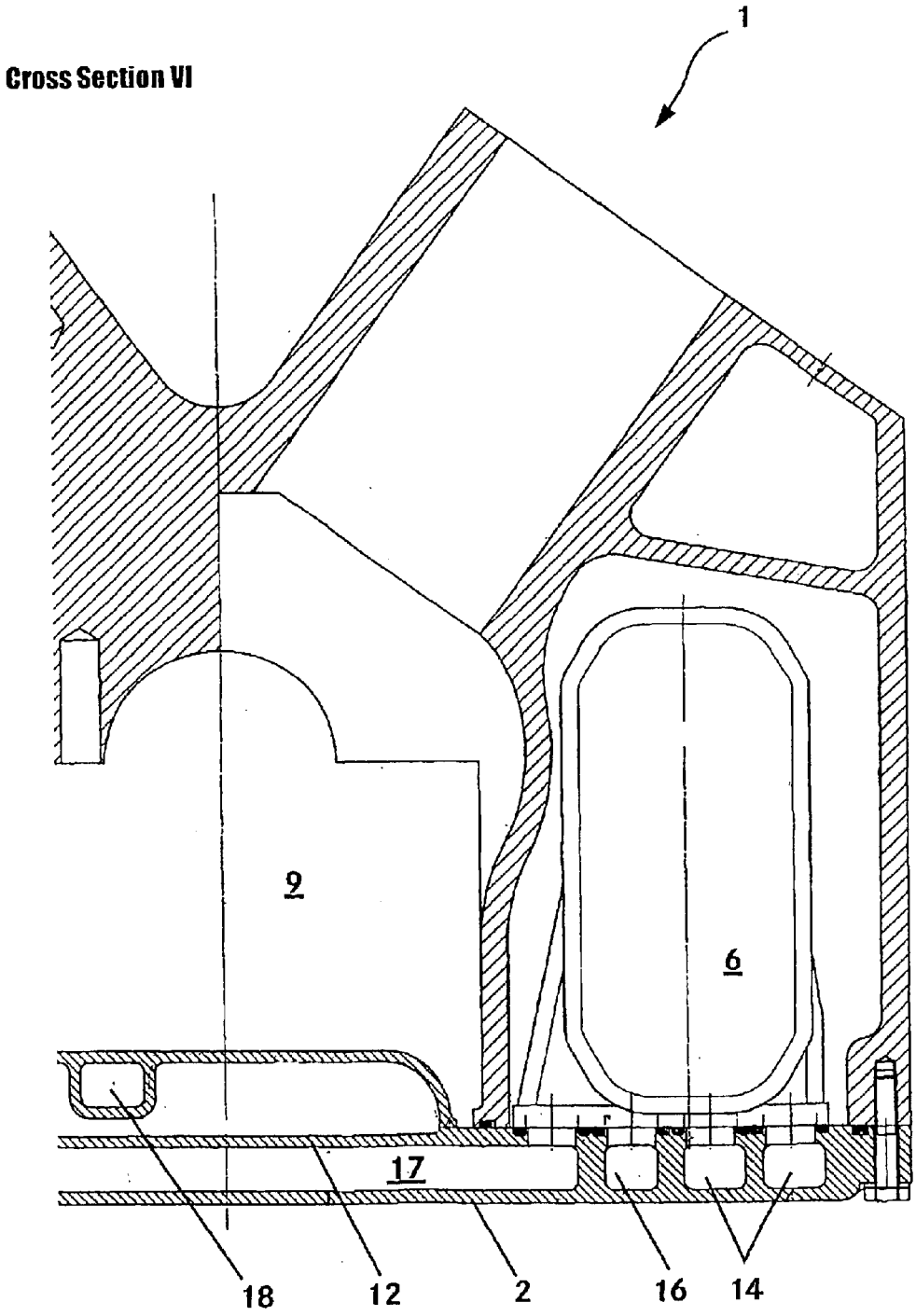
FIG. 6 is a third sectional view of the cover plate.

FIG. 6 shows a third sectional illustration through the right half of the crankcase 1 with the cover plate 2. In this section, the connections to a heat exchanger 6 are visible. The lubricant is fed by the pressure pump DP via the channel 17. The lubricant is drawn from the heat exchanger 6 to an oil filter through channel 16. The two channels 14 are used for the inlet and outlet of cooling water. As is apparent from what was described above, the cover plate 2 extends over the entire base of the crankcase 1. The auxiliary units, specifically the heat exchanger and pumps, along with the oil filter, are mounted on this cover plate 2. Together with the cover plate, these form a single structural unit. In this manner, the cover plate 2 and the mounted auxiliary units can be installed from the underside of the crankcase, in a single assembly step.

The solution of the invention offers the following advantages over the state of the art:

1. a simpler system for channeling various media. This results in fewer interfaces and a reduction in flow losses.

2. fewer lead-through openings for the media channels in the crankcase. With this feature, the crankcase can be manufactured more easily, and thus at a lower cost. Another advantage is that the crankcase/cover plate functional unit can be more easily adapted to meet the needs of the consumer. Furthermore, the probability of failure, e.g. due to porosity, is reduced.

3. increased service friendliness.

4. the side covers for seal the chambers 5 are dispensed with. This results in an increase in overall rigidity for the crankcase.

5. the engine mount can engage on the cover plate 2, or the engine can be installed on top of it.

What is claimed is:

1. Cover plate for a crankcase of an internal combustion engine in which, in addition to a crankshaft space, the crankcase is equipped with at least one additional chamber, in which auxiliary units are arranged, wherein the cover plate extends over the entire base of the crankcase to seal both the crankshaft space and the additional chamber.

2. Cover plate for a crankcase of an internal combustion engine in which, in addition to a crankshaft space, the crankcase is equipped with at least one additional chamber, in which auxiliary units are arranged, wherein the cover plate extends over the entire base of the crankcase, wherein the auxiliary units and a filter are mounted on the cover plate.

3. Cover plate in accordance with claim 2, wherein the cover plate has channels for channeling media and recesses.

4. Cover plate in accordance with claim 3, wherein the cover plate has channels for conveying cooling water.

5. Cover plate in accordance with claim 3, wherein the cover plate has a first and second pump suction point.

6. Cover plate in accordance with claim 5, wherein the cover plate has a fluid-channeling device by which lubricant is conducted out of the crankshaft space to the first and second suction points.

7. Method for assembling a cover plate in accordance with claim 1, the method comprising installing the cover plate with the auxiliary units mounted thereupon in the crankcase in a single operation.

8. A cover plate assembly for a crankcase of an internal combustion engine, wherein the crankcase has a base and a crankshaft space, the cover plate assembly comprising a cover plate and an auxiliary unit mounted to the cover plate and inside the crankcase, wherein the cover plate extends over the entire base of the crankcase.

9. The cover plate assembly in accordance with claim 8, comprising a plurality of auxiliary units.

10. The cover plate assembly in accordance with claim 9, wherein the plurality of auxiliary units includes a heat exchanger and pumps.

11. The cover plate assembly in accordance with claim 10, wherein the cover plate has a first and second suction point for the pumps.

12. The cover plate assembly in accordance with claim 8, further comprising a filter mounted to the cover plate.

13. The cover plate assembly in accordance with claim 8, wherein the cover plate has recesses and channels for channeling media.

14. The cover plate assembly in accordance with claim 13, wherein the channels include channels for conveying cooling water.

15. The cover plate assembly in accordance with claim 14, wherein the cover plate has a first and second suction point for the pumps.

16. The cover plate assembly in accordance with claim 14, wherein the cover plate has a fluid-channeling device by which lubricant is conducted out of the cranks space to the first and second suction points.

17. A method for mounting a cover plate assembly to a crank case, the method comprising:

mounting at least one auxiliary unit on a cover plate to form a cover plate assembly; and mounting the cover plate assembly to a base of the crankcase with the auxiliary unit inside the crankcase.

* * * * *